United States Patent [19]

Kashio

[11] 3,964,592

[45] June 22, 1976

[54] PRINTING MECHANISM FOR PRINTING CHARACTERS

[75] Inventor: Toshio Kashio, Tokyo, Japan

[73] Assignee: Casio Computer Co., Ltd., Tokyo, Japan

[22] Filed: Oct. 20, 1975

[21] Appl. No.: 623,562

Related U.S. Application Data

[63] Continuation of Ser. No. 452,972, March 20, 1974, abandoned.

[30] Foreign Application Priority Data

Mar. 24, 1973 Japan ..... 48-33722
Oct. 18, 1973 Japan ..... 48-117295

[52] U.S. Cl. ..... 197/49; 101/93.16; 101/93.29; 197/150

[51] Int. Cl.[2] ..... B41J 1/32; B41J 27/00

[58] Field of Search ..... 101/93.15–93.17, 101/93.21, 93.29, 93.3, 93.48, 269, 334; 197/49, 150

[56] References Cited

UNITED STATES PATENTS

| | | | |
|---|---|---|---|
| 2,982,205 | 5/1961 | Maul | 101/269 |
| 3,090,305 | 5/1963 | Keck | 101/334 |
| 3,291,042 | 12/1966 | Christoff et al. | 101/93.16 |
| 3,381,790 | 5/1968 | Chareneaud et al. | 197/49 X |
| 3,442,364 | 5/1969 | Ragen | 197/49 |
| 3,472,352 | 10/1969 | Kondur | 197/49 |
| 3,599,566 | 8/1971 | Fish | 101/333 |

OTHER PUBLICATIONS

IBM Tech. Disc. Bulletin, R. R. Bowdle, vol. 8, No. 10, Mar. 1966, p. 1432.

IBM Tech. Disc. Bulletin, Cowardin et al., vol. 13, No. 8, Jan. 1971, p. 2465.

*Primary Examiner*—Edgar S. Burr
*Assistant Examiner*—Paul T. Sewell
*Attorney, Agent, or Firm*—Flynn & Frishauf

[57] ABSTRACT

A printing mechanism for printing characters comprises a rotatable hammer confronting through a recording paper the surface of a character pattern bearing body having a plurality of character patterns embossed in a predetermined array on its surface; a striking mechanism adapted to be driven upon the supply of a printing instruction signal so as to cause the peripheral surface of the rotatable hammer to strike through the recording paper the character pattern located in a printing position; a mechanism for causing the rotatable hammer to be rotated through a predetermined angle in response to the striking movement of the rotatable hammer; and a mechanism for supplying a colored printing material to the peripheral surface of the rotatable hammer for either within or without the rotatable hammer.

2 Claims, 4 Drawing Figures

PRINTING MECHANISM FOR PRINTING CHARACTERS

This is a continuation of application Ser. No. 452,972, filed Mar. 20, 1974, now abandoned.

This invention relates to a printing mechanism for printing a character on a recording paper by causing a printing hammer to strike through a recording paper any selected character pattern embossed on a character pattern bearing body, and particularly to a printing mechanism capable of obviating the necessity of using any inking sheet.

There is known a mechanical printing device in which a character pattern selected by a printing character selecting instruction strikes the surface of a platen through a recording paper whereby the character is printed on the recording paper. With this device it is necessary to dispose an inking sheet such as an ink ribbon in front of the recording paper and, furthermore, a mechanism for driving the ink ribbon etc. is complicated in design and difficulty is presented in effecting printing at high speed.

Also known is a device in which a plurality of character patterns are arranged in a predetermined array on the surface of a rotatable drum and printing is effected by causing a hammer to strike through a recording paper any selected character pattern arranged on the rotatable drum. With this device, a printing character selecting mechanism for rotating a drum by a printing character selecting instruction is provided independently of a mechanism for printing a character selected by a character printing instruction. Consequently, printing can be effected at high speed and, furthermore, a mechanical construction can be made simplified. However, it is necessary to place an inking sheet in front of a recording paper. For example, where an ink ribbon is put in front of a recording paper, an actual printing condition can not be evaluated unitl printing is completed along one line of the recording paper. Where, for example, a character printing instruction is manually given, the evaluation of the printing condition is often required.

It is accordingly the object of this invention to provide a printing mechanism for printing characters, capable of effecting printing without using any inking sheet when a character is printed on a recording paper by causing a hammer to strike any selected character pattern embossed on a character pattern bearing body.

SUMMARY OF THE INVENTION

A present device comprises a character pattern bearing body having a plurality of character patterns embossed in a predetermined array on its surface and adapted to be driven so that a character pattern to be printed is located in a printing position; a rotatable hammer disposed so as to confront the arrayed character patterns through a recording paper and having a colored printing material supplied to its peripheral surface; a striking mechanism adapted to drive the rotatable hammer upon the supply of a character printing instruction signal so as to cause the rotatable hammer to strike the character pattern to be printed through the recording paper at its peripheral surface to permit the character to be printed on the recording paper with the colored printing material; and a mechanism for causing the rotatable hammer to be rotated through a predetermined angle in response to the striking movement of the rotatable hammer.

According to this invention, the progress of printing can always be evaluated, since no inking sheet is provided in front of a recording paper. Furthermore any restriction is not imparted to a printing speed and printing can be carried out with a sharp distinctness.

The character pattern bearing body can be constructed in the form of a rotatable drum, flat plate etc. A printing character selecting operation is further facilitated by using a rotatable drum and arranging character patterns in a specified array on the rotatable drum. The rotatable hammer can be so constructed that a colored printing material is supplied from within the rotatable hammer per se to its peripheral surface. It is also possible to supply a colored printing material from a separately provided colored printing material supply device to the surface of the rotatable hammer. The selection of printing characters can be easily effected by rotating the rotatable drum and/or moving the rotatable drum in its axial direction. The colored printing material is not restricted entirely to be liquid. A solid colored material in the form of powder etc. may also be used.

BRIEF DESCRIPTION OF THE DRAWINGS

This invention can be more fully understood from the following detailed description when taken in conjunction with the accompanying drawings, in which.

DETAILED DESCRIPTION OF THE ILLUSTRATED EMBODIMENTS

Figure 1:
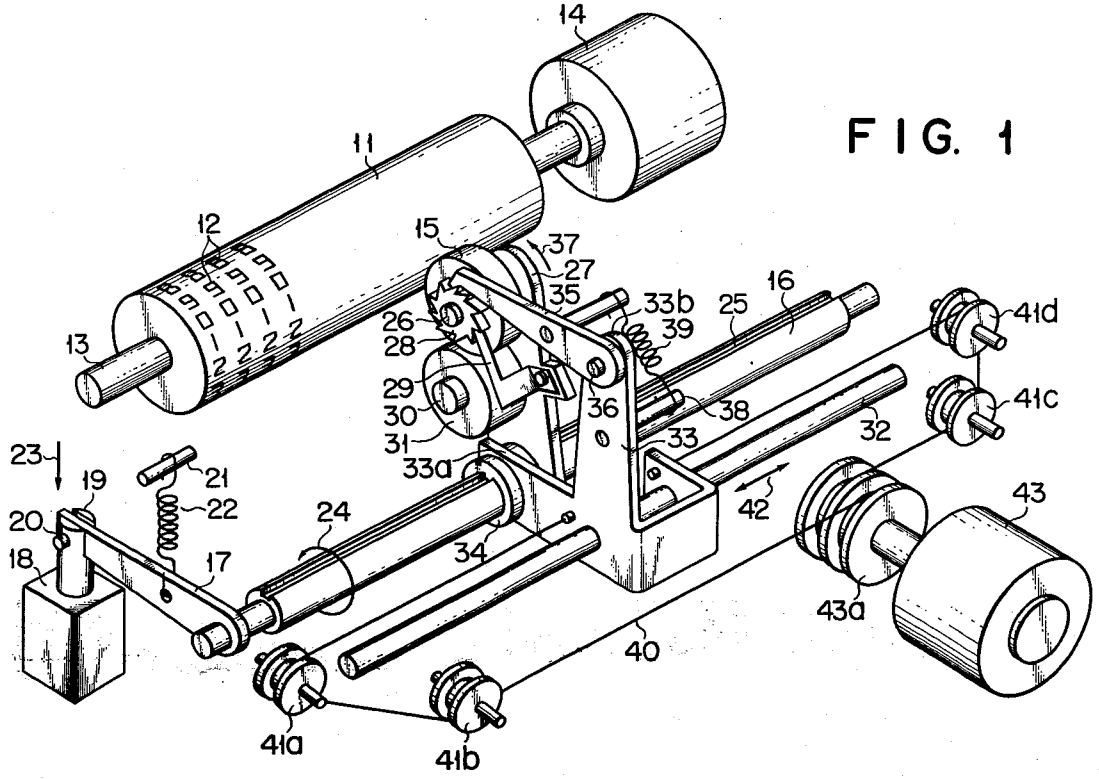
FIG. 1 is a perspective view showing one embodiment of this invention.

In FIG. 1 character pattern bearing body is constructed as a printing drum 11.

A plurality of character patterns 12 are embossed on a printing drum surface and arranged in the form of columns perpendicular to a rotation shaft 13 of the drum 11. A group of prescribed characters is arranged in a prescribed pattern in each column. A spacing between the respective columns corresponds to the printing pitch on a recording paper. The characters to be printed are selected by controlling the rotational angle of the printing drum by means of a pulse motor 14 adapted to be driven by printing character selecting signals. A support shaft 16 for supporting a rotatable hammer 15 to be described later is disposed parallel to the rotation shaft 13 and one end of the support shaft, as shown to the left of the figure, is secured to one end of a lever 17. A plunger including a solenoid 18 and a movable shaft 19 is provided. The other end of the lever 17 is pivotally mounted by means of a pin 20 to the end of the movable shaft 19. Midway of the lever 17 one end of a spring 22 is anchored and the other end of the spring is anchored to a fixed shaft 21 so that the lever 17 is biased upwardly as shown in the figure. When a printing instruction signal is supplied to the solenoid 18, the shaft 19 is attracted in a direction of an arrow 23 to cause the support shaft 16 to be swung in a direction of an arrow 24. When no printing instruction signal is supplied to the solenoid, the shaft 19 is held in a position shown in FIG. 1 under the biasing force of the spring 22. That is, the shaft is held in a position occupied before the shaft is swung. A groove 25 is provided along the axis of the shaft 16. A hammer lever 27 swingably supports the rotatable hammer 15 through a shaft 26. The lower end of the hammer lever 27 is engaged with the shaft 16 so that the lever 27 is swung, through an angle of the shaft 16, together with the shaft. The hammer lever 27 is also movable along the groove 25 of the shaft 16.

At one side of the rotatable hammer 15 is secured a ratchet 28 movable relative to the shaft 26. One end of the elastic member 29 is supported by the hammer lever 27 and the other end of the elastic member is engaged with the tooth of the ratchet to prevent its reverse rotation. An ink roller 31 is rotatably supported on a shaft 30 mounted to the hammer lever 27 and rotated in a manner that its peripheral surface is contacted with the peripheral surface of the rotation hammer 15. The ink roller is made of, for example, a porous elastic body impregnated with colored printing material or ink and supplies the ink to the peripheral surface of the rotation hammer 15.

Figure 2:
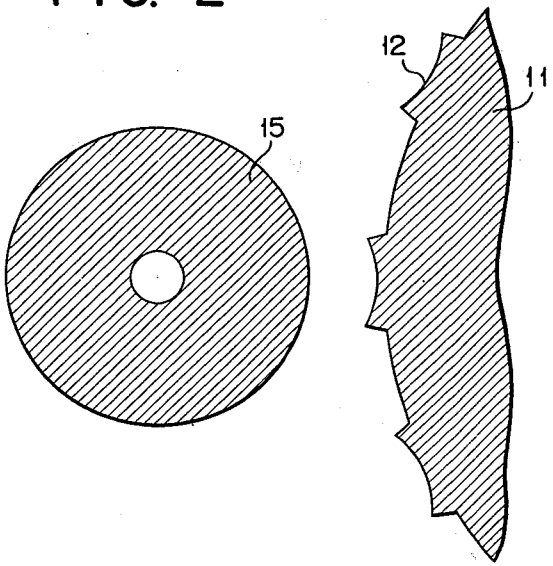
FIG. 2 is an enlarged, fragmentary and sectional view showing a relation between the peripheral surface of a rotatable hammer and the outer surface of each character pattern embossed on the peripheral surface of a character pattern bearing body.

A fixed guide shaft 32 is disposed parallel to the shaft 16 and a projecting member 33 is movably mounted over the shaft 32 and is movable along the longitudinal direction of the shaft 16. One projecting end 33*a* of the member 33 is sandwiched between the hammer lever 27 and a holding member 34 and is not swung by the swinging movement of the shaft 16 since it was mounted over the fixed shaft 32. To the other projecting end 33*b* of the member 33, one end of an anchoring lever 35 is pivotally supported with an axis 36 as a center. The other end of the anchoring lever 35 is engaged with the tooth of the ratchet 28 so as to cause the rotatable hammer 15 to be advanced one step in a direction indicated by an arrow 37 when the rotatable hammer 15 strikes, through a recording paper (not shown), the surface of a printing drum by the operation of the above-mentioned plunger and is returned to an original position. To make such an operation smooth, a spring 39 is disposed between a pin 38 provided midway of the lever 35 and a pin 38 provided on the member 33 so as to impart a biasing force to the lever 35. To cause the rotatable hammer 15 to be moved along the longitudinal direction of the shaft 13, the member 33 ties up with a wire 40 and the wire 40 is guided around guide rollers 41*a*–41*d* and moved in a direction indicated by an arrow 42. A reference numeral 43 indicates a pulse motor adapted to be driven by a printing character selecting signal. The wire 40 is entrained around a pulley 43*a* so that the member 33 can be moved in the direction shown by an arrow 42.

Where the peripheral surface of the rotatable hammer 15 is circular in shape, printing can be effected with sharp clearness by making the curvature radius of the surface of each character pattern 12 on the printing drum equal to the curvature radius of the peripheral surface of the rotation hammer 15. In this case, printing can be performed with sharp distinctness simply by using a different impact surface of the rotation hammer at each printing operation. The relative relation between the outer surface of the character pattern and the outer surface of the rotation hammer is not restricted only to the relation as shown in FIG. 2. For example, where the peripheral surface of the rotatable hammer is made polygonal in shape so as to provide a flat impact surface, the outer surface of the character pattern is correspondingly made flat. Where the peripheral surface of the rotatable hammer is made polygonal in shape so as to provide a concave impact surface, the outer surface of the character pattern is correspondingly made convex.

With the above-mentioned embodiment, when a printing character selecting instruction signal is applied to the pulse motors 14 and 43, control is made to cause the rotatable hammer to confront a selected character pattern through the recording paper. At the same time, a printing instruction signal is applied to the solenoid 18 of the plunger device to cause the movable shaft 19 to be attracted in the direction indicated by an arrow 23. This causes the shaft 16 to be swung in the direction shown by the arrow 24 to permit the rotatable hammer 15 to strike the selected character pattern through the recording paper, whereby the character is printed on the recording paper. Upon the return of the rotatable hammer to the original position, the rotatable hammer is rotated one step under the interaction of the ratchet 28 and the lever 35. The ink roller 31 is rotated in accordance with the rotation of the rotation hammer 15 to supply ink on the peripheral surface of the rotation hammer 15. Therefore, a clear printing is performed on the printing paper.

Where there are provided on the shaft 16 rotation hammers and the corresponding striking mechanisms corresponding in number to the character patterns arranged along one row of the printing drum 11, printing can be effected along one line of the recording paper merely by rotating the printing drum.

Figure 3:
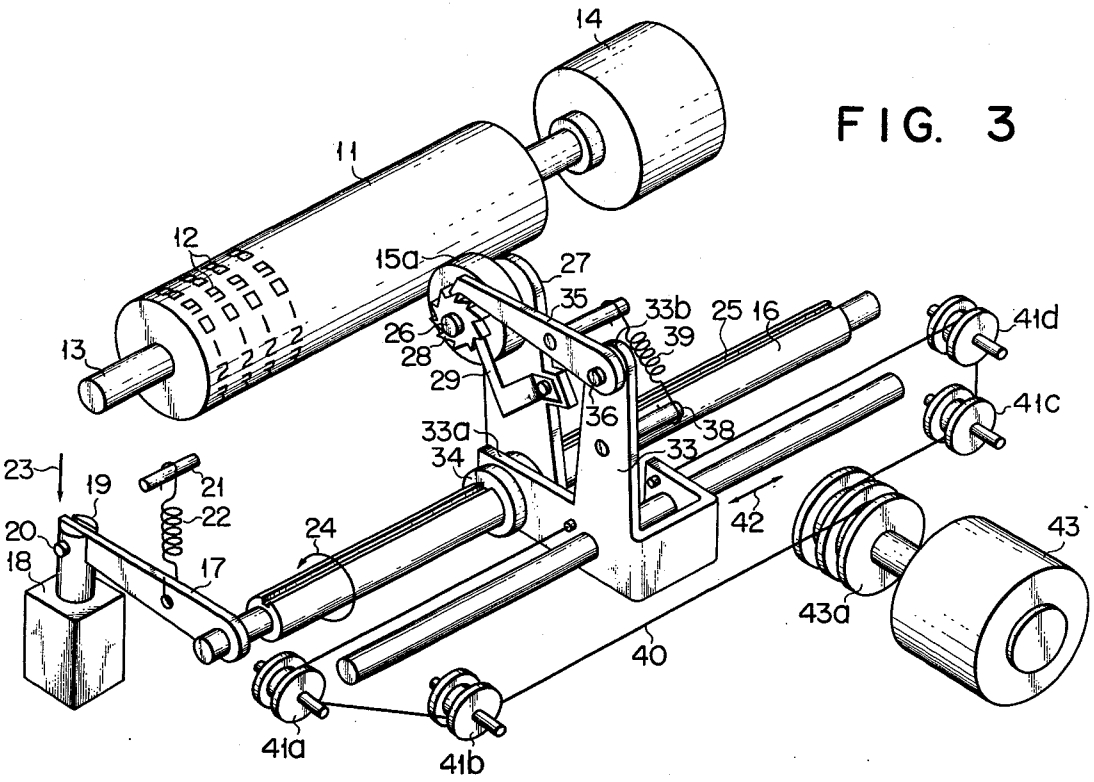
FIG. 3 is a perspective view showing a modification of this invention.

In FIG. 3, a rotatable hammer 15*a* has a colored printing material supplied to its outer periphery from the interior of the rotation hammer per se. In this case, the rotatable hammer 15*a* is formed by compressing powdered resin under high pressure within a mold followed by solidifying the resultant shaped mass, and then impregnating it with a colored printing material such as ink etc. when the rotatable hammer strikes the printing drum 11 through the recording paper, the colored material impregnated into the rotatable hammer is oozed out on the impact surface so that printing is effected on the recording paper. The rotatable hammer may be constructed using an oil impregnable metal. In this case, ink is impregnated instead of oil into the metal hammer. The embodiment of FIG. 3 is identical to the embodiment of FIG. 1 except for the rotation hammer 15*a* and any further explanation is therefore omitted.

Figure 4:
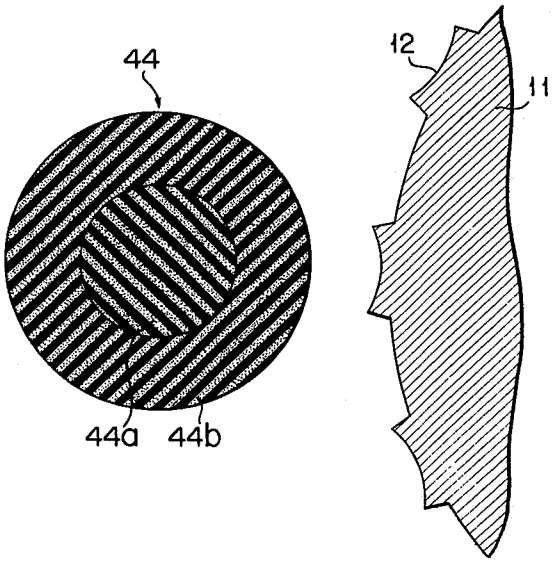
FIG. 4 is an enlarged, fragmentary and sectional view showing a modification of the rotatable hammer of FIG. 3.

In FIG. 4, a rotatable hammer 44 has a central circular portion 44*a* formed of a porous material having a greater ink impregnating capability, and an outer peripheral surface formed of a porous material permitting an impregnating ink to be gradually oozed out toward the outer surface of the rotatable hammer. An ink supply mechanism may be provided, as required, in the central circular portion 44*a* of the rotation cylinder.

What is claimed is:

1. A printing mechanism for printing characters responsive to a printing signal, comprising:

a cylindrical character pattern bearing body having a plurality of character patterns embossed in a predetermined array on its surface and adapted to be rotated so that a character pattern to be printed is located in a printing position;

a rotatable hammer driven so as to confront the character pattern to be printed through a recording paper and urged to strike the character pattern through the recording paper to print the character on the recording paper in a colored printing material supplied to the peripheral surface of the hammer;

a driving mechanism for driving the rotatable hammer which comprises a fixed first shaft parallel to the cylinder axis of said cylindrical pattern bearing body, a slide member slideably mounted to the first shaft and slideable along the first shaft, a rotatable second shaft parallel to the cylinder axis of said cylindrical pattern bearing body and which is rotated responsive to a printing signal and which supports the slide member to allow the slide member to move along the second shaft, a hammer lever coupled to the sliding member and slideably movable along the second shaft together with the sliding member and coupled to the second shaft so as to rotate along with the second shaft, said rotatable hammer being rotatably supported at the free end of the hammer lever, a toothed ratchet rotated with the rotation of the rotatable hammer, an anchoring lever one end of which is pivotally supported at the sliding member and the other end of which is engaged with a tooth of the ratchet to rotate the rotatable hammer by a predetermined rotation angle for each character printing, and an elastic member one end of which is pivotally supported on the hammer lever and the other end of which is engaged with a tooth of the ratchet to prevent reverse rotation of the rotatable hammer; and a mechanism adapted to be contacted with the peripheral surface of the rotatable hammer so as to supply the colored printing material to the peripheral surface of the rotatable hammer.

2. A printing mechanism for printing characters responsive to a printing signal, comprising:

a cylindrical character pattern bearing body having a plurality of character patterns embossed in a predetermined array on its surface and adapted to be rotated so that a character pattern to be printed is located in a printing position;

a rotatable hammer, made of a solidified body impregnated with colored printing material, driven so as to confront the character pattern to be printed through a recording paper and urged to strike the character pattern through the recording paper to print the character on the recording paper in the colored printing material oozed out therefrom on the impacted surface thereof; and a driving mechanism for driving the rotatable hammer which comprises a fixed first shaft parallel to the cylinder axis of said cylindrical pattern bearing body, a slide member slideably mounted to the first shaft and slideable along the first shaft, a rotatable second shaft parallel to the cylinder axis of said cylindrical pattern bearing body and which is rotated responsive to a printing signal and which supports the slide member to allow the slide member to move along the second shaft, a hammer lever coupled to the sliding member and slideably movable along the second shaft together with the slide member and coupled to the second shaft so as to rotate along with the second shaft, said rotatable hammer being rotatably supported at the free end of the hammer lever, a toothed ratchet rotated with the rotation of the rotatable hammer, an anchoring lever one end of which is pivotally supported at the sliding member and the other end of which is engaged with a tooth of the ratchet to rotate the rotatable hammer by a predetermined rotation angle for each character printing, and an elastic member one end of which is pivotally supported on the hammer lever and the other end of which is engaged with a tooth of the ratchet to prevent reverse rotation of the rotatable hammer.

* * * * *